US008215323B2

(12) United States Patent
Kramer et al.

(10) Patent No.: US 8,215,323 B2
(45) Date of Patent: Jul. 10, 2012

(54) DRIVE SYSTEMS FOR CONVEYOR-TYPE WAREWASHERS

(75) Inventors: Steven H. Kramer, Osgood, OH (US); Brian A. Brunswick, Tipp City, OH (US); Gary A. Gerber, West Milton, OH (US)

(73) Assignee: Premark FEG L.L.C., Wilmington, DE (US)

( * ) Notice: Subject to any disclaimer, the term of this patent is extended or adjusted under 35 U.S.C. 154(b) by 657 days.

(21) Appl. No.: 12/374,697

(22) PCT Filed: Jul. 24, 2007

(86) PCT No.: PCT/US2007/074146

§ 371 (c)(1),
(2), (4) Date: Jan. 22, 2009

(87) PCT Pub. No.: WO2008/014215

PCT Pub. Date: Jan. 31, 2008

(65) Prior Publication Data

US 2010/0000582 A1 Jan. 7, 2010

Related U.S. Application Data

(60) Provisional application No. 60/833,422, filed on Jul. 26, 2006.

(51) Int. Cl.
*B08B 3/00* (2006.01)

(52) U.S. Cl. ..... 134/137; 134/56 D; 134/57 D; 134/58 D; 134/198

(58) Field of Classification Search ..... None
See application file for complete search history.

(56) References Cited

U.S. PATENT DOCUMENTS 2,548,131 A 4/1951 Stern
(Continued)

FOREIGN PATENT DOCUMENTS

CN 2503839 Y 8/2002
(Continued)

OTHER PUBLICATIONS

International Search Report and Written Opinion, PCT/US2007/074146 (mailed Feb. 20, 2008) (International Search Report published Apr. 10, 2008).

(Continued)

*Primary Examiner* — Michael Kornakov
*Assistant Examiner* — Nicole Blan
(74) *Attorney, Agent, or Firm* — Thompson Hine LLP

(57) ABSTRACT

A conveyor-type warewash machine includes a housing through which racks of wares are passed along a conveyance path for cleaning. A rack drive system includes a rack engaging structure that moves back and forth in first and second directions. When moving in the first direction, the rack engaging structure moves an adjacent rack forward along the conveyance path. When moving in the second direction, the rack engaging structure leaves the adjacent rack substantially stationary. The drive system is configured to move the rack engaging structure in the first direction at a first average speed and to move the rack engaging structure in the second direction at a second average speed. The second average speed is faster than the first average speed so that the adjacent rack spends more time moving forward than being stationary. A seal assembly may be provided about a drive shaft of the drive system.

12 Claims, 16 Drawing Sheets

U.S. PATENT DOCUMENTS

| | | | | | |
|---|---|---|---|---|---|
| 2,660,293 | A | | 11/1953 | Merritt | |
| 2,777,566 | A | | 1/1957 | King | |
| 2,848,102 | A | | 8/1958 | Whitney | |
| 3,043,237 | A | | 7/1962 | McKee et al. | |
| 3,494,077 | A | * | 2/1970 | Clarke | 451/163 |
| 3,612,253 | A | * | 10/1971 | Hoffman et al. | 198/729 |
| 3,760,936 | A | | 9/1973 | Vilen et al. | |
| 4,456,117 | A | | 6/1984 | Szczepanski | |
| 4,505,381 | A | | 3/1985 | Major | |
| 4,598,818 | A | | 7/1986 | Miller | |
| 4,884,893 | A | * | 12/1989 | Zeiffer et al. | 366/168.1 |
| 5,105,636 | A | * | 4/1992 | Anastase et al. | 68/140 |
| 5,178,261 | A | | 1/1993 | Matheson et al. | |
| 5,263,378 | A | | 11/1993 | Loomer | |
| 5,282,529 | A | | 2/1994 | Schwammle | |
| 5,355,847 | A | * | 10/1994 | Ozeki | 123/41.44 |
| 5,465,826 | A | | 11/1995 | Noestheden | |
| 6,012,567 | A | | 1/2000 | Ferguson et al. | |
| 6,026,831 | A | | 2/2000 | Jarvis | |
| 6,550,607 | B1 | | 4/2003 | Watson et al. | |
| 6,955,179 | B2 | | 10/2005 | Ecker et al. | |
| 6,959,714 | B1 | | 11/2005 | Hakansson et al. | |
| 2003/0156771 | A1 | * | 8/2003 | Varel et al. | 384/477 |
| 2004/0092178 | A1 | * | 5/2004 | Creighton | 440/83 |

FOREIGN PATENT DOCUMENTS

| | | |
|---|---|---|
| DE | 19829650 | 1/2000 |
| EP | 1523928 | 4/2005 |
| WO | 2004/019748 | 3/2004 |
| WO | WO 2004019748 A1 * | 3/2004 |

OTHER PUBLICATIONS

International Preliminary Report on Patentability, PCT/US2007/074146 (Feb. 5, 2009).

* cited by examiner

DRIVE SYSTEMS FOR CONVEYOR-TYPE WAREWASHERS

CROSS-REFERENCE TO RELATED APPLICATIONS

This application claims priority to U.S. Provisional Application No. 60/833,422, filed Jul. 26, 2006, entitled Drive Systems for Warewashers.

TECHNICAL FIELD

This application relates generally to pass through type warewashers which are used in commercial applications such as cafeterias and restaurants and, more particularly, to a drive system for moving wares through such warewashers.

BACKGROUND

Commercial warewashers commonly include a housing area which defines the washing and rinsing area for dishes, pots pans and other wares. A conveyor is used to transport the wares through the warewasher from an input side to an output side. At the output side of the warewasher a ware receiving table/trough may extend several feet to allow cleaned wares to exit from the warewasher completely before being removed by kitchen personnel.

U.S. Pat. No. 6,550,607 describes a warewasher including a conveyor drive arrangement including a jam detection system. The warewasher includes a conveyor drive arrangement including a drive motor assembly formed by a drive motor and reduction gear box, with the rotational axis of the assembly being substantially upright. The drive motor assembly includes a rotating output shaft. A rotatable slip clutch includes an input side operatively connected for rotation by the drive motor assembly output shaft, and an output side operatively connected for driving a dog-type conveyor. Specifically, the output side is connected with an upright shaft that extends to a crank arm. As the crank arm rotates in a clockwise direction (looking from top to bottom along the rotational axis) it repeatedly engages a drive block. The dog-type conveyor moves racks containing wares through the machine on tracks in a stop and go fashion with every rotation of the crank arm. The dogs are attached to a cradle that is suspended below the tracks on plastic slider blocks. The cradle is made to oscillate back and forth in the direction of arrow by the rotating crank arm and drive block, propelling the racks forward on every forward stroke of the cradle by way of the dogs engaging with webs on the bottoms of the racks. The drive block runs in a channel. During the reverse stroke of the cradle, the cradle dogs disengage from the rack webs (pivoting downward as they contact other webs on the reverse movement) and the racks remain stationary (commonly referred to as dwell time) until the next forward stroke of the cradle. In this arrangement, on average racks moved through the warewasher are generally stationary for the same duration of time that they are moving forward. That is, the rack must hesitate while the conveyor is returning to the drive position flooding some of the rack wear with wash and rinse water. During the driving of the rack, some ware is washed with a lesser amount of water. To overcome this lower amount of water, the wash and rinse system is designed to meet dish cleanliness criteria during the movement of the rack. The system is "over washing" the ware during the long stops as a result meaning that the wash and rinse system could be more efficient if a conveyor system with less dwell time were designed.

It is more effective to push/pull the racks through the warewasher at a more even rate (e.g., less stationary time) to ensure more even water distribution to the wares.

Several designs were considered for a constant motion conveyor system including a stainless steel drive chain and a chemical resistant belt. The stainless drive chain would do a fine job moving the rack but the current cost to implement such a system in a conveyor machine would be several times more expensive than that of a ratcheting conveyor. Corrosion resistant plating on a carbon steel chain would be available at a lesser cost but the long-term reliability would be an issue as the plating wore off the chain, which would lead to rust. The belt design is lower cost but belt materials do not currently exist at this time that can withstand the chemicals, heat, and hold tension in the machine to meet quality and reliability standards.

SUMMARY

In an aspect, a conveyor-type warewash machine includes a housing through which racks of wares are passed along a conveyance path for cleaning. A rack drive system includes a rack engaging structure that moves back and forth in first and second directions. When moving in the first direction, the rack engaging structure moves an adjacent rack forward along the conveyance path. When moving in the second direction, the rack engaging structure leaves the adjacent rack substantially stationary. The drive system is configured to move the rack engaging structure in the first direction at a first average speed and to move the rack engaging structure in the second direction at a second average speed. The second average speed is faster than the first average speed so that the adjacent rack spends more time moving forward than being stationary.

In another aspect, a method of conveying a rack of wares through a conveyor-type warewash machine includes: providing a housing through which racks of wares are passed along a conveyance path for cleaning; and moving a rack engaging structure back and forth in first and second directions, when moving in the first direction the rack engaging structure moves an adjacent rack forward along the conveyance path, when moving in the second direction the rack engaging structure leaves the adjacent rack substantially stationary, the rack engaging structure is moved in the first direction at a first average speed and is moved in the second direction at a second average speed, where the second average speed is faster than the first average speed so that the adjacent rack spends more time moving forward than being stationary.

In a further aspect, a conveyor-type warewash machine includes a housing through which wares are passed along a conveyance path for cleaning and a plurality of spray nozzles within the housing. A ware conveying system includes a drive shaft that extends through a wall of the housing. A drive shaft seal assembly includes a substantially stationary bearing housing having a face adjacent the inner surface of the wall and an opening through which the drive shaft passes, and a water deflector disposed about the bearing housing and coupled for movement with the drive shaft.

In another aspect, a conveyor-type warewash machine includes a housing through which wares are passed for cleaning and a plurality of spray nozzles within the housing. A ware conveying system includes a drive shaft extending through a wall of the housing. A drive shaft seal assembly includes a bearing housing located adjacent an inner surface of the wall and through which the drive shaft extends, and a water deflector disposed about the bearing housing. An inner surface of the water deflector spaced from an outer surface of the bearing housing. The outer surface of the bearing housing includes a peripherally extending trough formed therein, the trough positioned such that water that that enters an upper portion of the drive shaft seal assembly between the bearing housing and the water deflector tends to flow downward along the trough.

The details of one or more embodiments are set forth in the accompanying drawings and the description below. Other features, objects, and advantages will be apparent from the description and drawings, and from the claims.

DESCRIPTION

By way of introduction, various drive systems are contemplated for improving movement of racks of wares through a warewasher. For example, a center drive dual ratchet (not shown) has two drive arms. As one arm drives the rack, while the second arm retracts. When a driving bar starts to retract, the second arm picks up the rack and starts pushing. This motion is achieved with a four bar linkage on the input drive motor. The benefit is that the rack only hesitates during the time it takes the second arm to engage the rack. The rack is pushed through the system at a nearly continuous rate, the dishes are pushed to the exit tabling evenly, and the design is simple and reliable.

Figure 1:
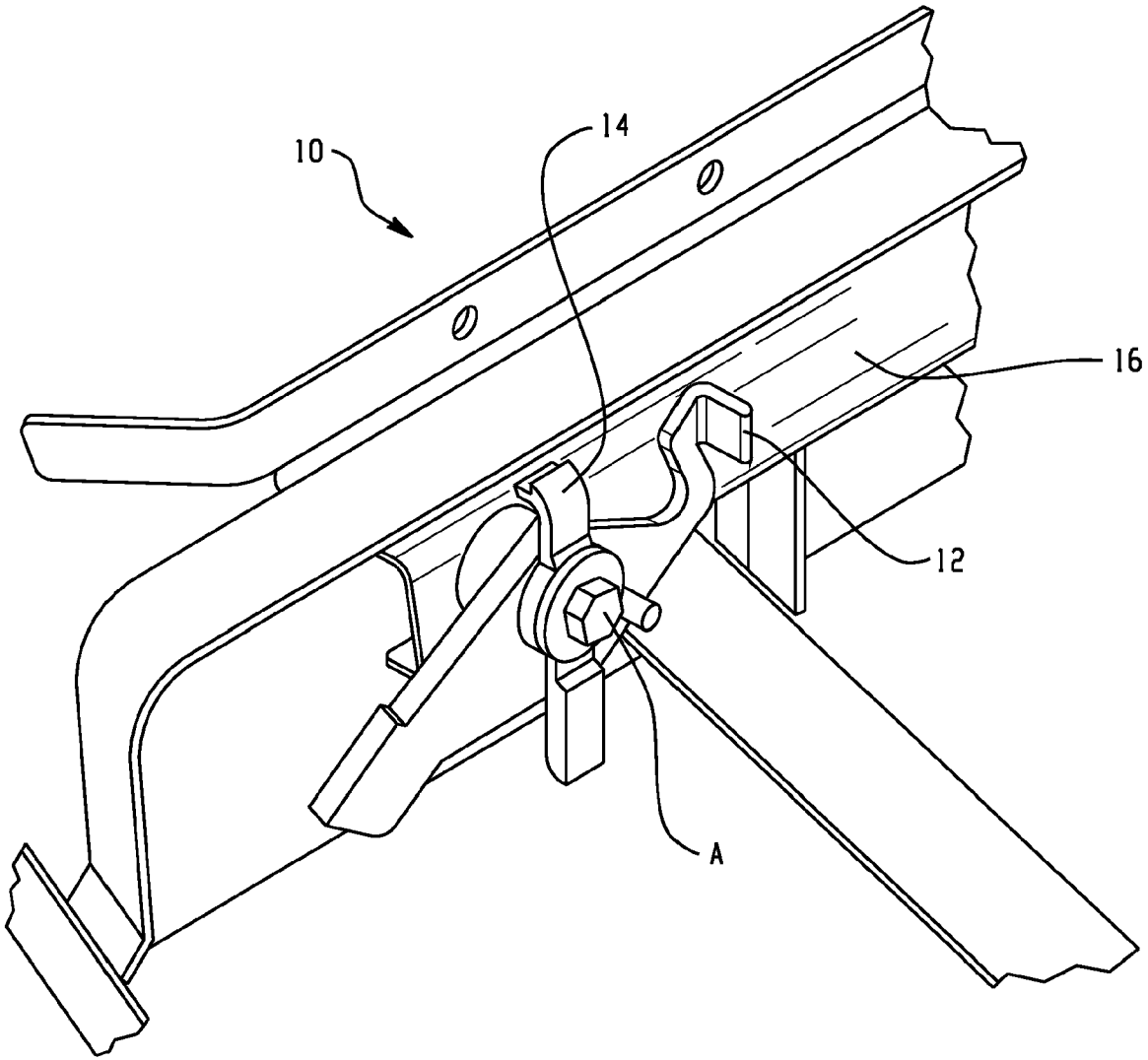
FIGS. 1 and 2 are detailed, perspective views of an embodiment of a rack engaging system for conveying a rack of wares.
Figure 2:
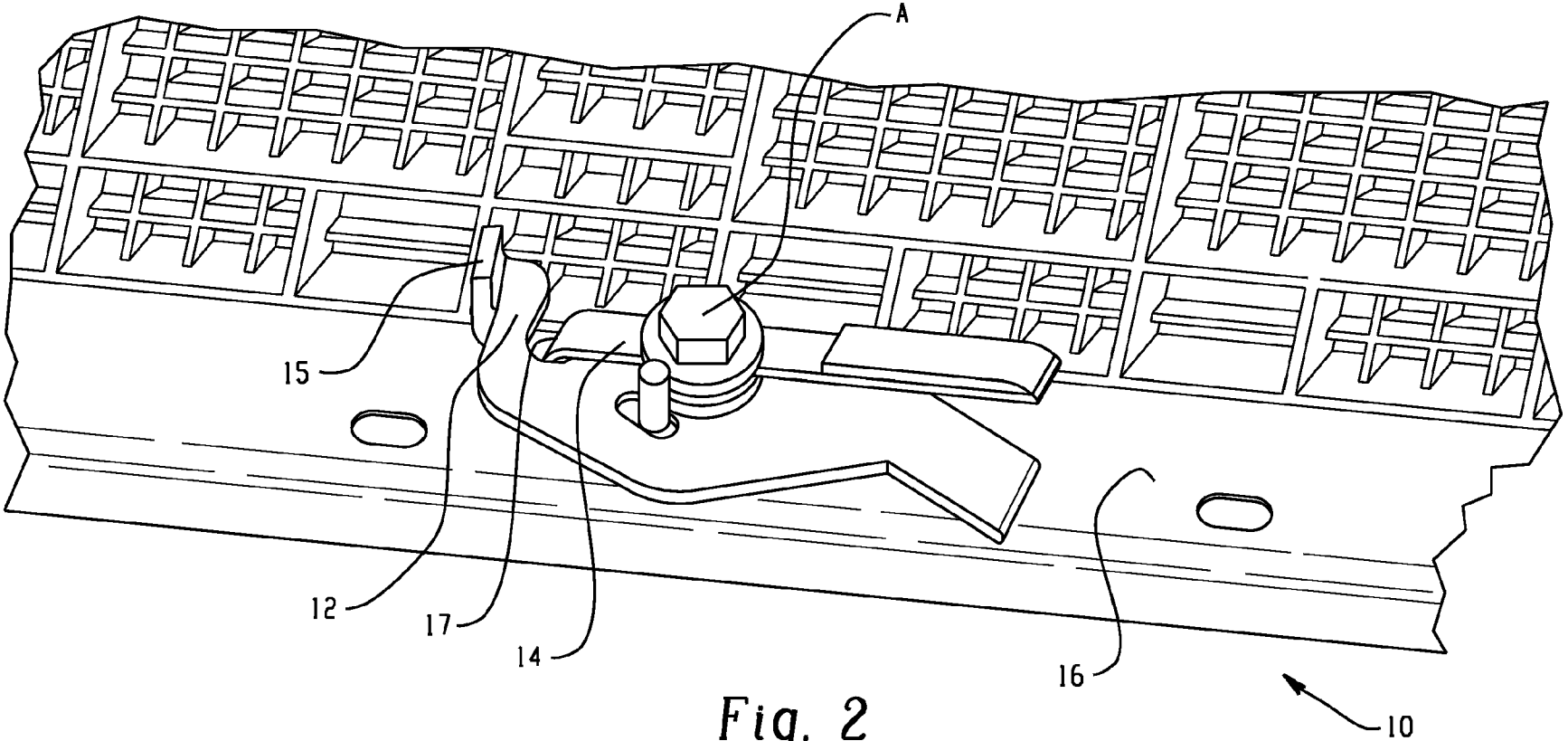
Figure 3:
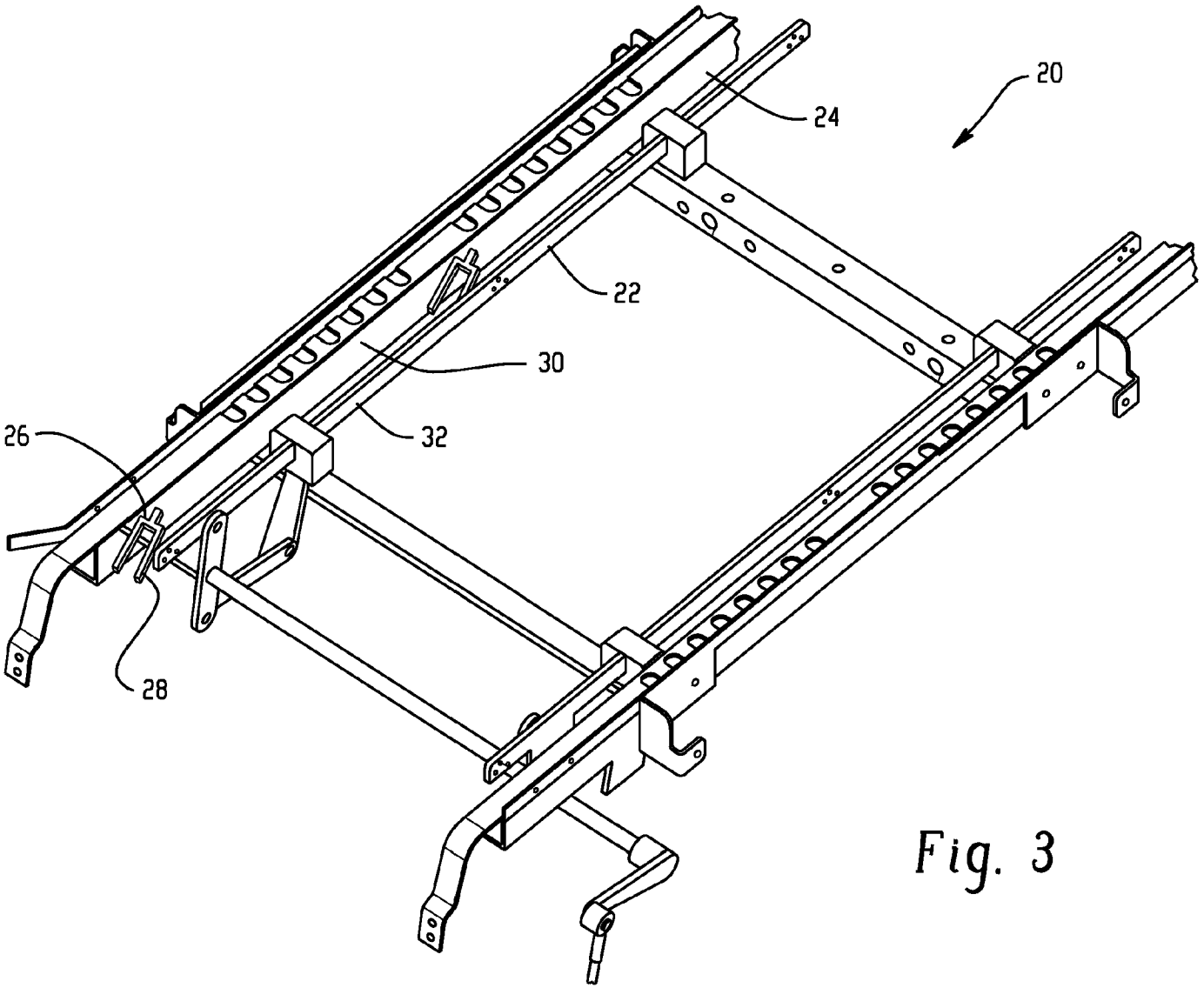
FIGS. 3-6 illustrate another embodiment of a rack engaging system for conveying a rack of wares.
Figure 4:
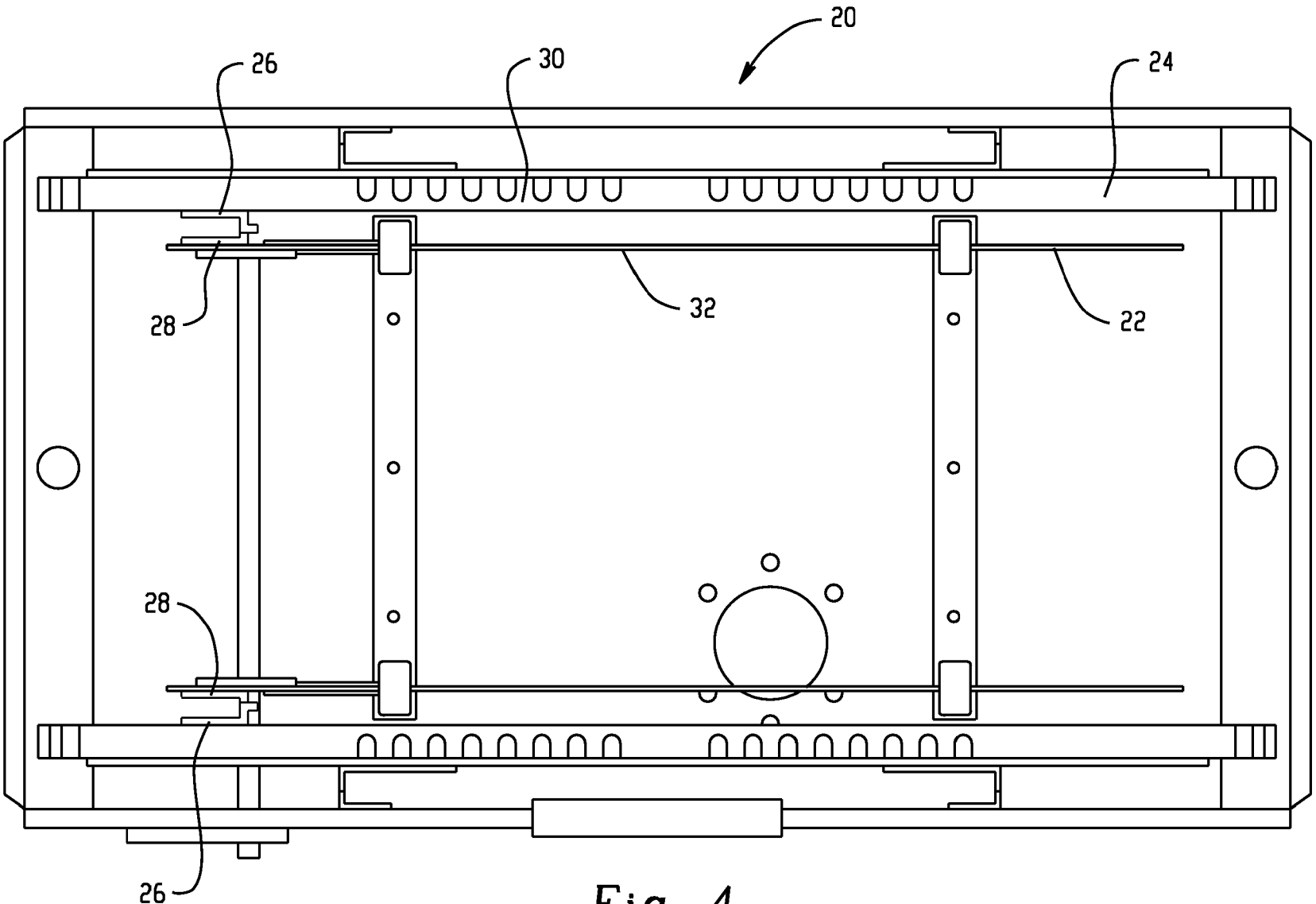
Figure 5:
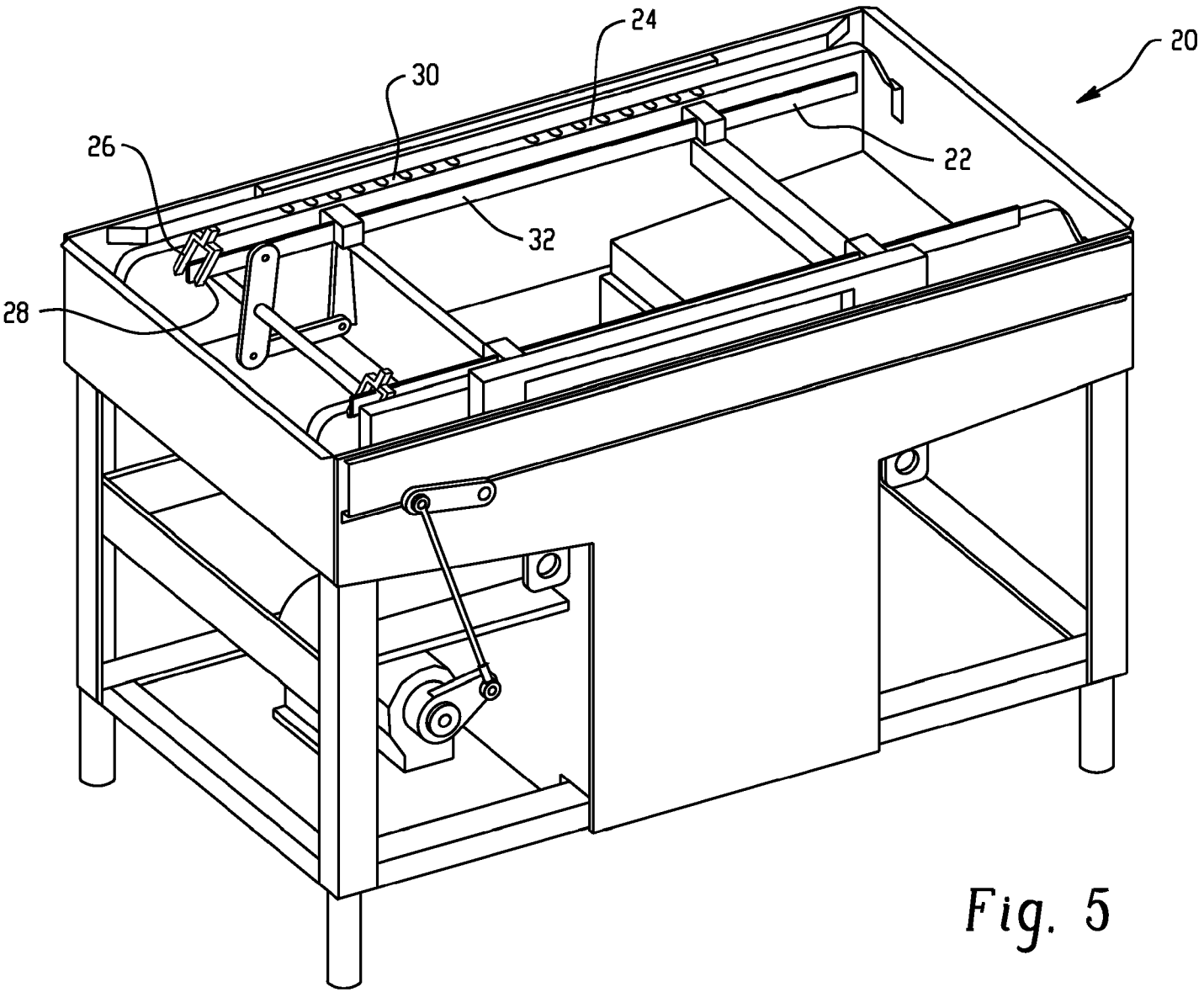
Figure 6:
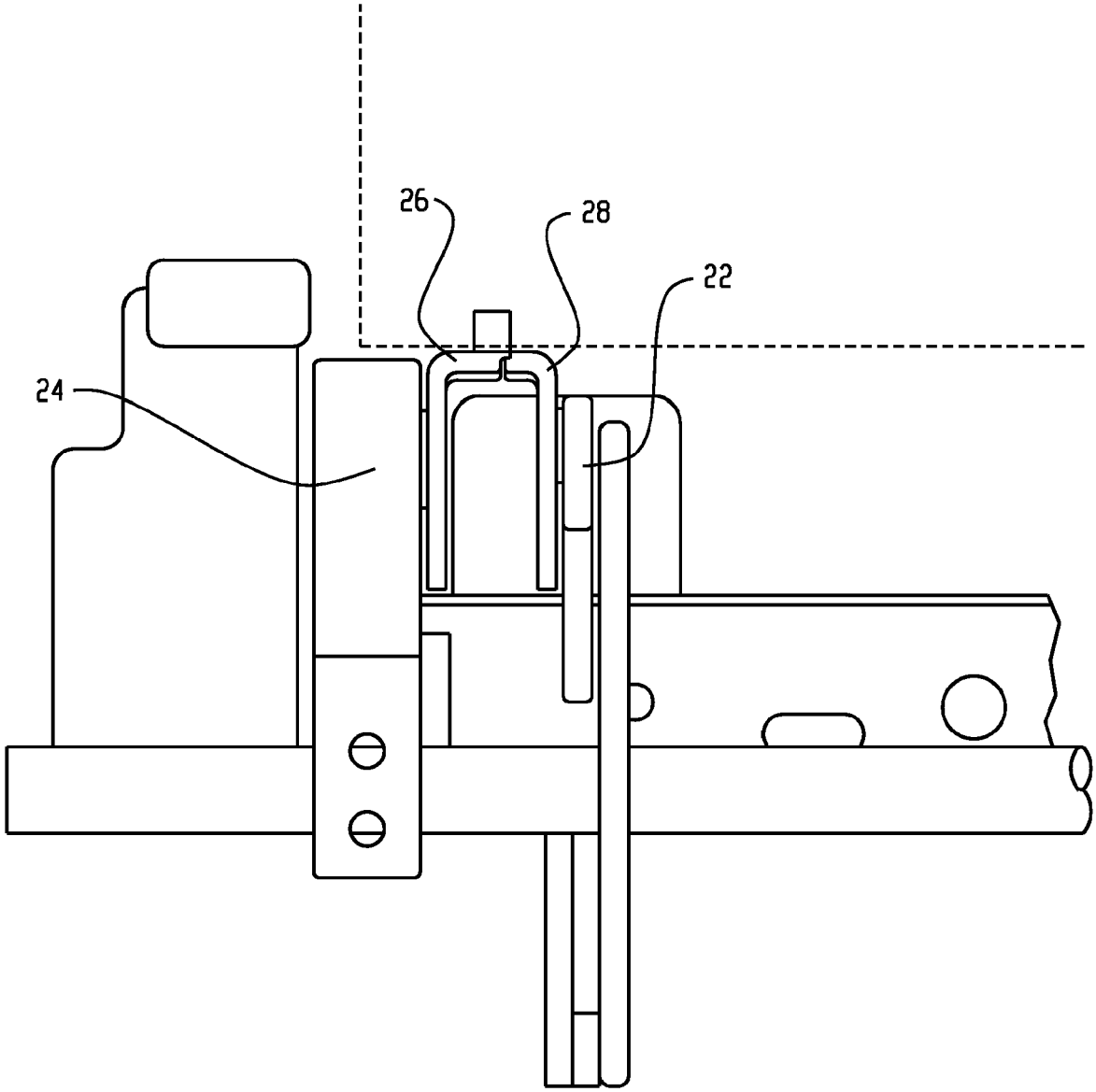

A "double dog" arrangement 10 is shown per FIGS. 1 and 2. Two dogs 12 and 14 are located on the same pivot axis A and the stroke length of a cradle 16 connected to the dogs is shortened. The two dogs 12 and 14 are arranged so that rack engaging portions 15 and 17 of the two dogs are offset from each other along the travel distance through the warewasher. The first dog 12 pushes the rack during a first forward stroke with the dog engaging a specific rack web. The cradle 16 is reversed to a position where the second dog 14 can engage the same web, then the cradle is again moved forward. The cradle 16 is reversed again so that the first dog 12 can catch the next web of the rack. The short, quick strokes of the double dog arrangement 10 provide more starts and stops, and thus more consistent coverage as between wares on different portions of the racks. Still, the wares are generally stationary for the same amount of time they are moving forward.

A "dual ratchet" system 20 is shown per FIGS. 3-6. The dual ratchet system 20 uses both an inner cradle 22 and an outer cradle 24. When one cradle 22, 24 is driving racks forward, the other cradle is moving backward to move into position to make the next forward driving motion for the racks. Thus, dwell time for each rack is reduced significantly. Due to the narrowness of the web area on most dish racks, there is not enough drive area on the rack web to allow dogs 26, 28 on the inner and outer cradle 22, 24 to pass by each other. Accordingly, the drive dogs 26, 28 are mounted and configured so that the driving dog will cause the backward moving dog to lay down generally flat to avoid interference. Complexity is an issue with this design, as it utilizes eight different drive links to drive the arms 30, 32. This potentially leads to reliability issues in that joints will wear and pieces of washed ware could get into the system and cause a jam, shutting down the machine.

Rapid Return Conveyor

Figure 7:
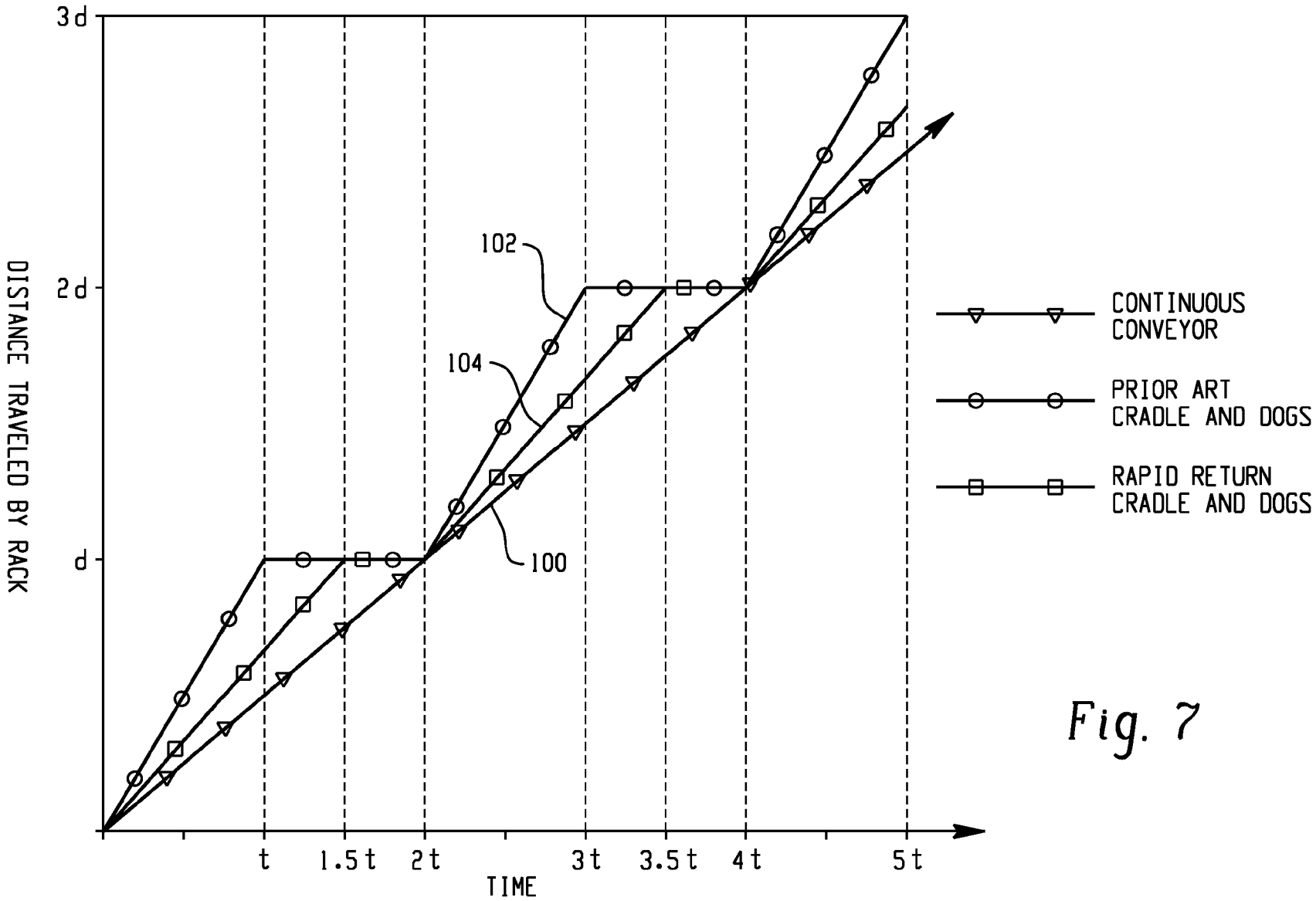
FIG. 7 is an exemplary graph of a rack travel distance over time.
Figure 16:
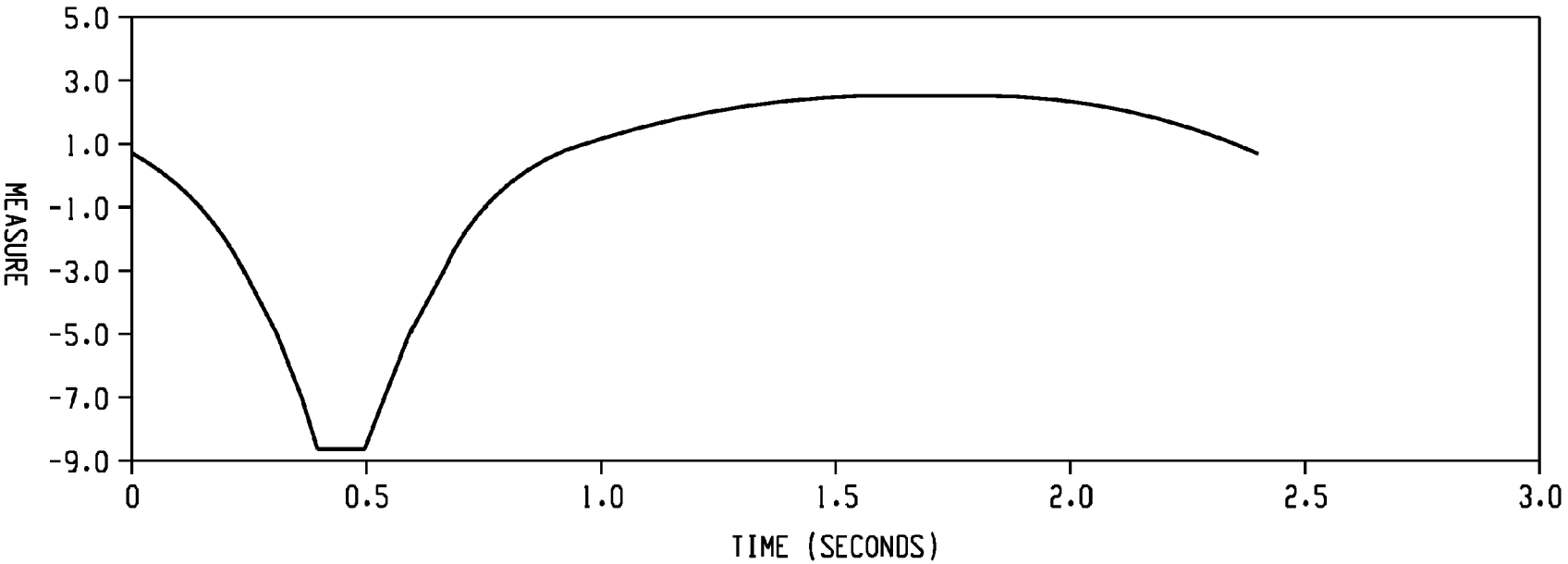
FIG. 16 is an exemplary graph of a conveyor speed curve.

Referring now to FIG. 7, a warewasher drive system in the nature of a "rapid return" system is discussed. FIG. 7 shows an exemplary graph of rack travel distance over time. Curve 100 represents a continuous conveyor, curve 102 represents an rough approximation of a prior art cradle and dog drive (i.e., where rack dwell time is the same as the rack forward moving time, typical conveyor design) and curve 104 represents a rough approximation of the concept of a rapid return conveyor. In curves 102 and 104, while rack movement is depicted in straight-line, constant-slope form (e.g., the rack movement depicted in curve 102 between time 2t and time 3t or the rack movement depicted in curve 104 between time 2t and time 3.5t), in reality rack movement would necessarily involve some acceleration and deceleration so that the line would not be of constant slope. Moreover, in a drive arrangement that converts rotary motion of a crank into back and forth pivotal motion of a shaft, which is then converted into back and forth linear motion (as in the embodiment described below using slide blocks) the resulting speed would not be linear. In this graph the curves are depicted linear for the sake of understanding. FIG. 16 shows an exemplary conveyor speed curve to one implementation of the embodiment of the rapid return conveyor described below, where negative speed values reflect the return or backward movement of the conveyor and positive speed values reflect the forward movement of the conveyor. Because the velocity changes during forward and reverse movement of the conveyor due to acceleration, average velocities will be referred to herein, which is the change in distance divided by the change. As can be seen by FIG. 16, the average velocity during reverse movement of the conveyor is greater than the average velocity during forward movement of the conveyor assuming the distance moved by the conveyor during forward and reverse travel is about the same.

In the rapid return conveyor concept, the conveyor is still repeatedly ratcheted forward and backward, but the rack dwell time is reduced significantly by moving the conveyor (e.g., cradle and dogs) backward at an average velocity that is substantially greater (i.e., at least about 30% greater) than the conveyor is moved forward. In the graph of FIG. 7 the conveyor moves forward about 75% of the time, and backward only about 25% of the time. Variations on this breakdown are possible. While the rapid return feature could be implemented using many different conveyor configurations, the following embodiment is described with respect to a cradle and dog conveyor.

Figure 8:
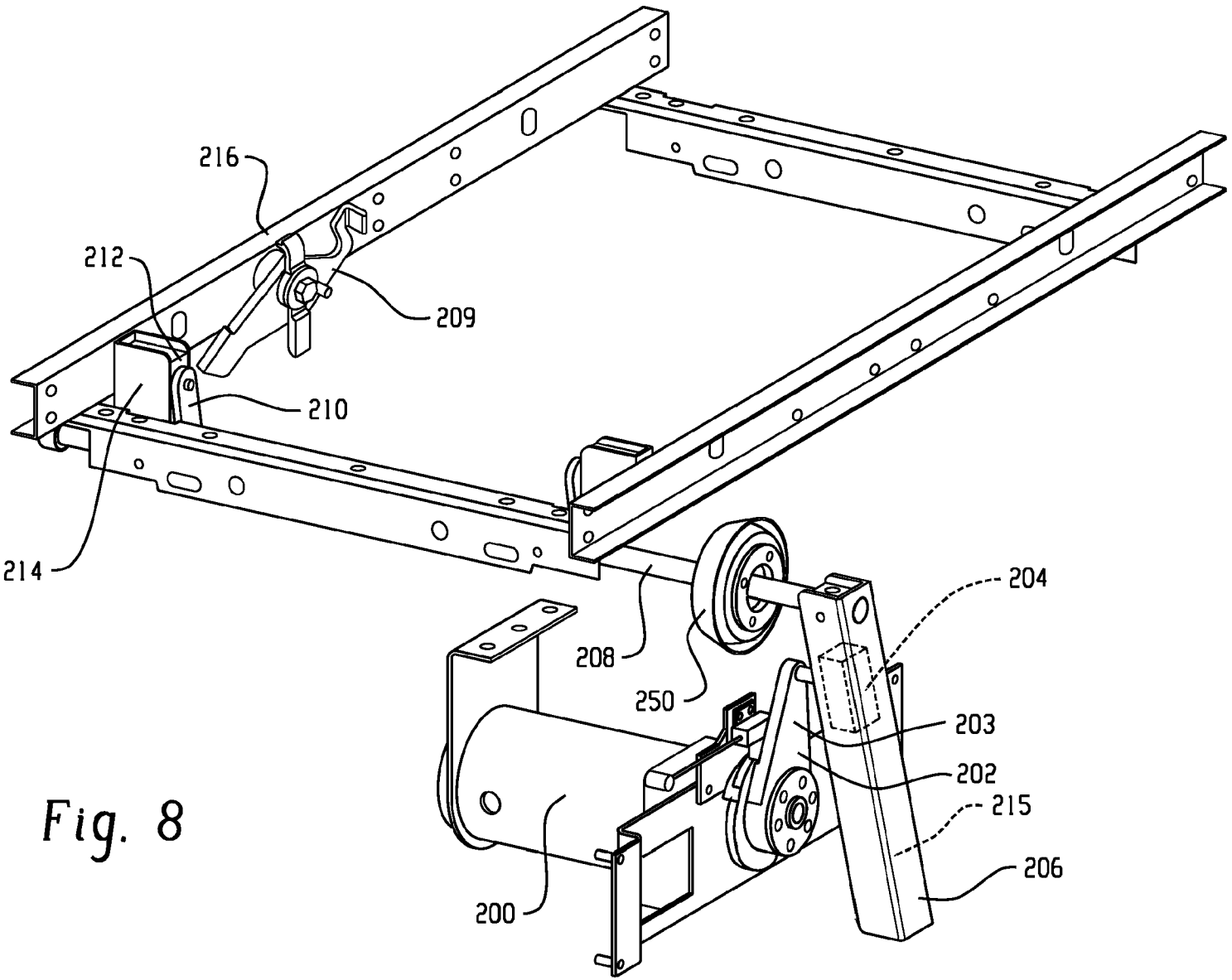
FIGS. 8-13 are various views illustrating drive elements for an embodiment of a rapid return conveyor system.
Figure 9:
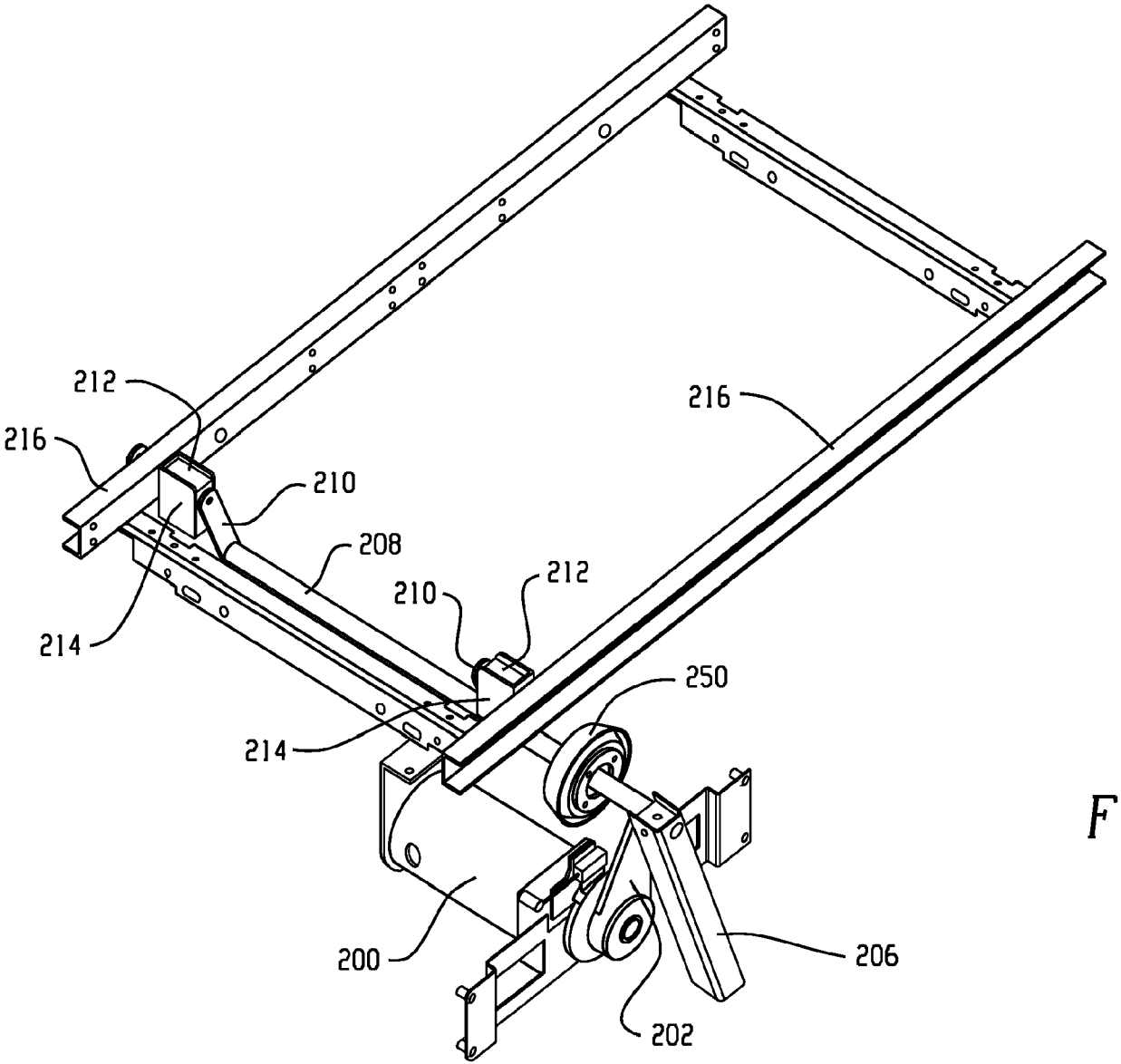
Figure 10:
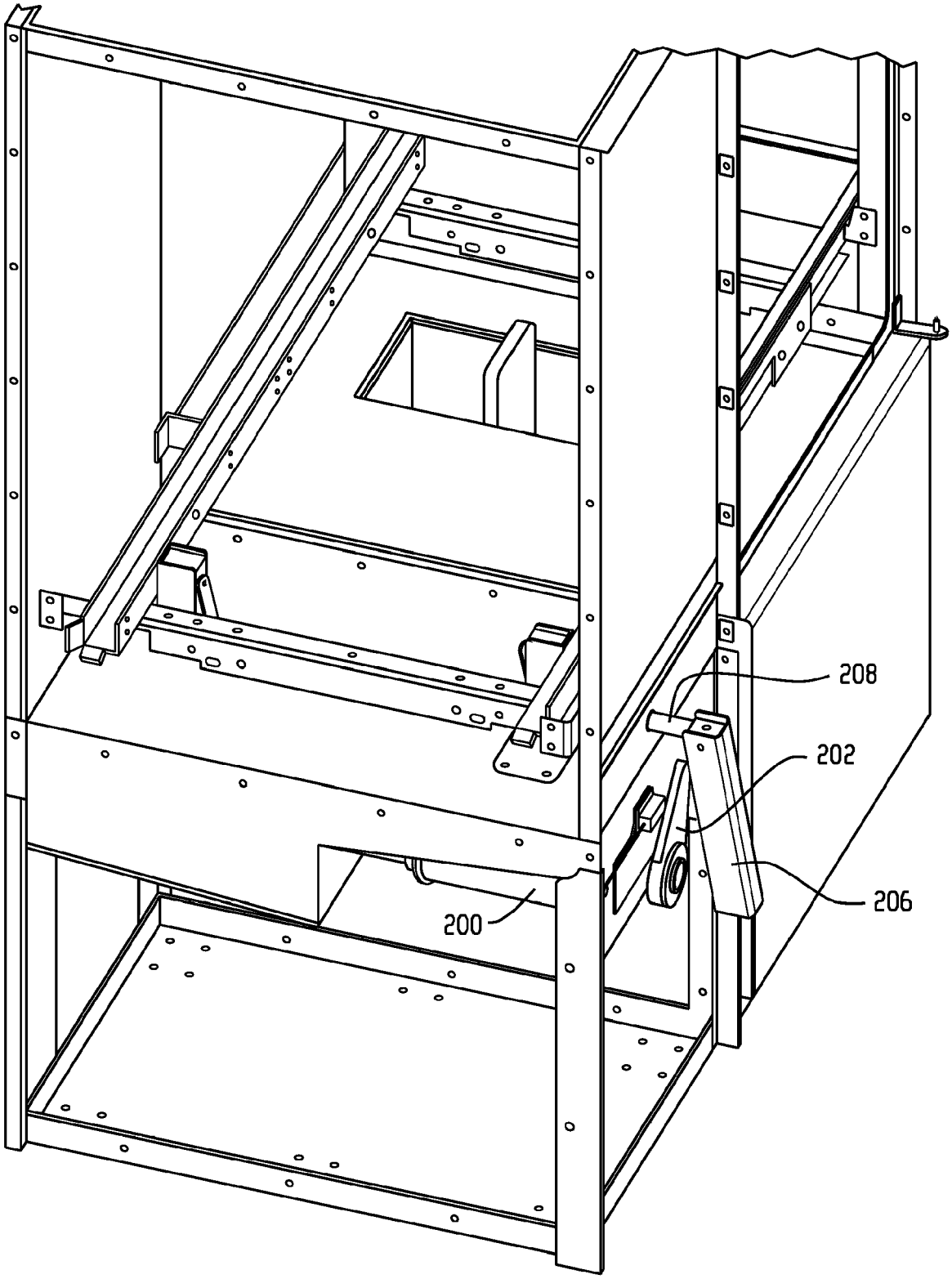
Figure 11:
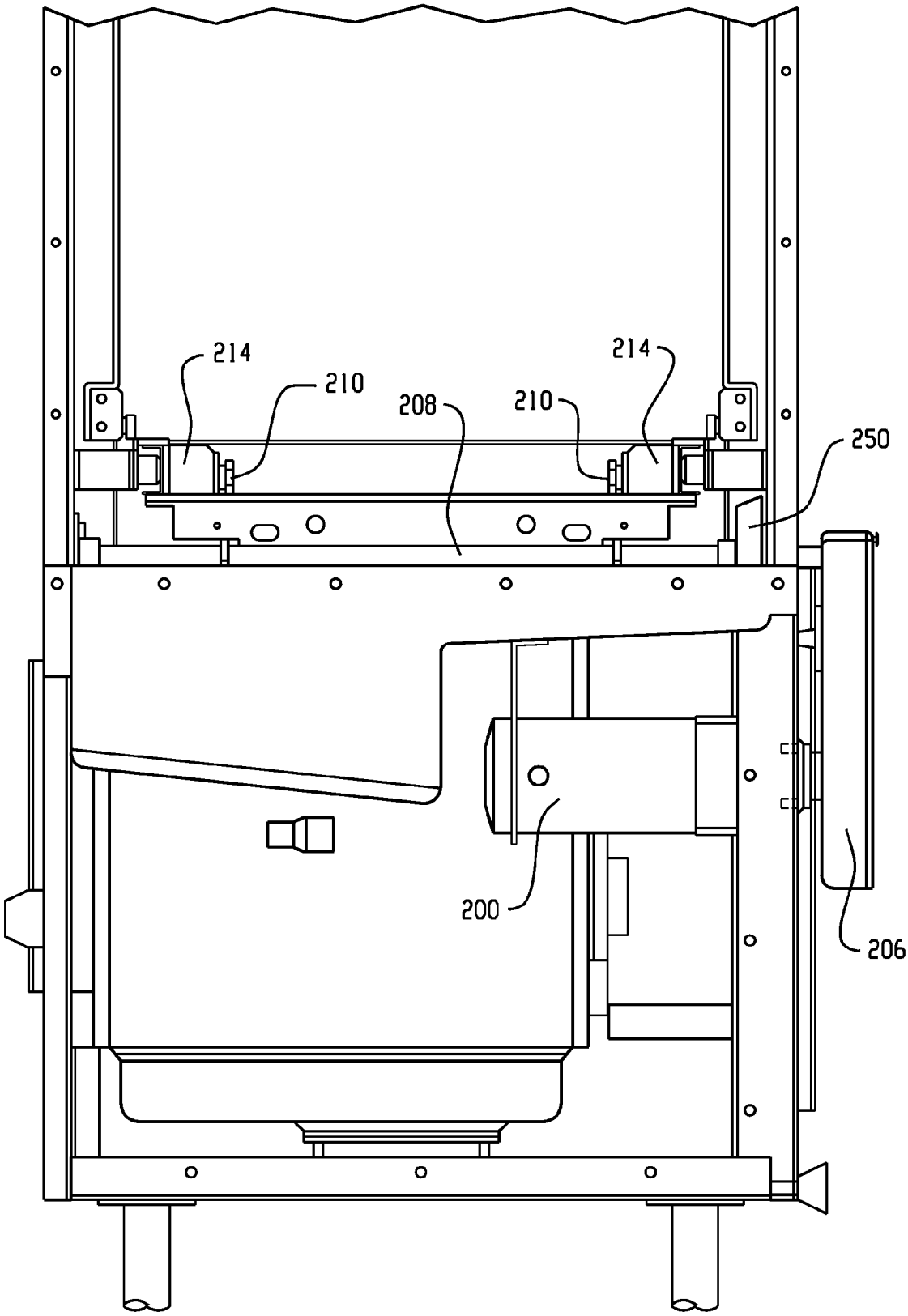
Figure 12:
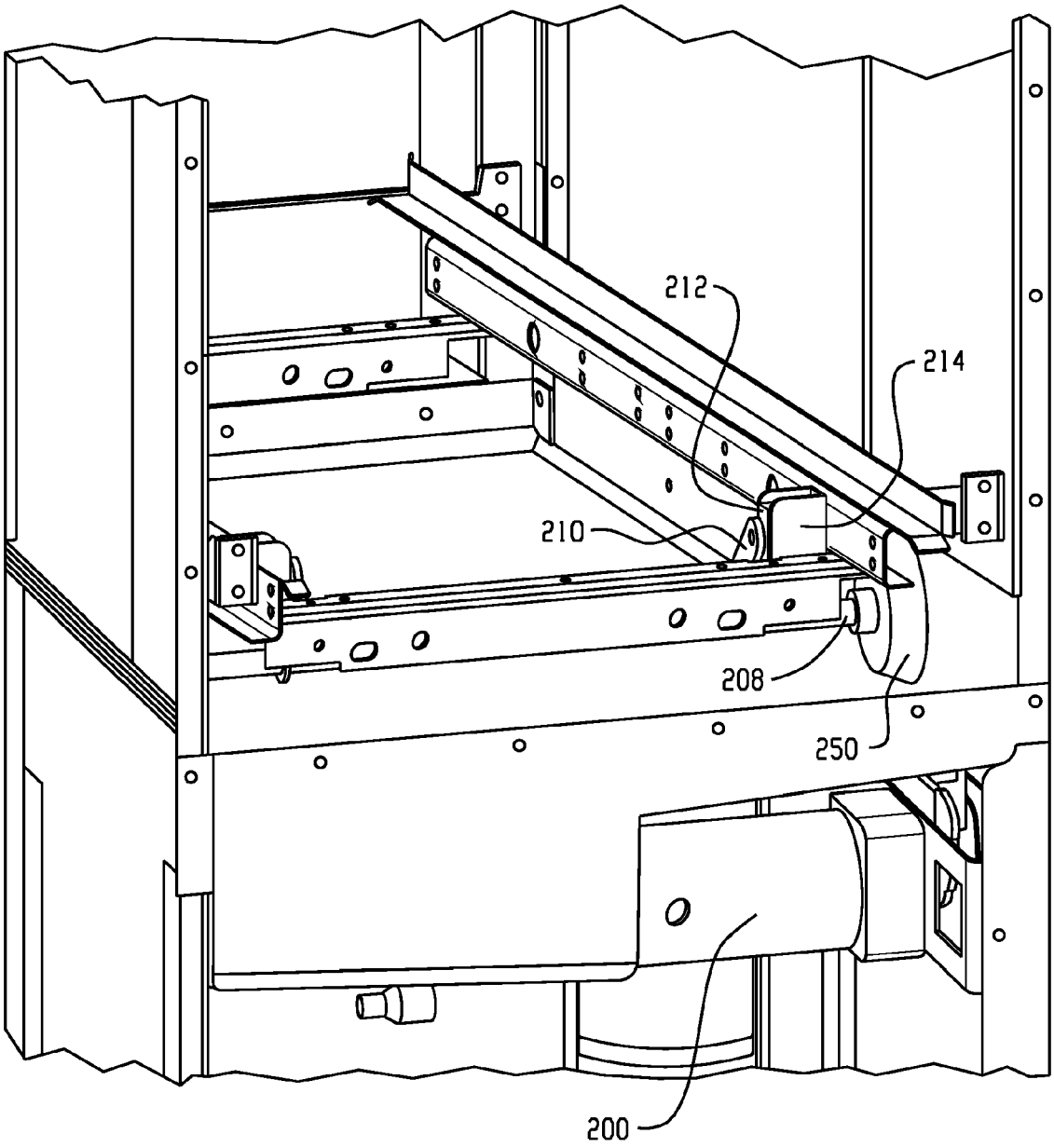

Referring now to FIGS. 8-14, basic drive system elements of this embodiment include a drive motor 200 that effects rotation of a drive crank 202. The drive crank (which may be at the output side of overprotection slip clutch forming part of a jam detection system) 202 includes a radially extending arm 203 that is pivotally connected to a slide block 204 (shown in shadow) at a distal end of the arm to effect back and forth arcuate movement of an oscillating member 206 including a channel that extends a length of the oscillating member along which the slide block travels. The oscillating member 206 is connected with a cradle drive shaft 208 that includes spaced apart drive brackets 210 extending therefrom. Each drive bracket 210 is pivotally connected with a corresponding slide block 212 that moves within a corresponding channel guide 214 that is connected to the cradle side rail 216. When the drive shaft 208 is rotated clockwise (when viewed from the end of the shaft that is connected to the oscillating member 206) the brackets 210 rotate in the forward direction (relative to the path of travel through the warewasher) causing the slide blocks 212 to interact with the channel guides 214 and move the cradle and its dogs forward. Only double dog 209 is shown in FIG. 8 and is not shown in the remaining FIGS. 9-13. However, a single dog, or any other suitable rack engaging structure, could be used. Conversely, when the drive shaft 208 is rotated counterclockwise (when viewed from the end of the shaft that is connected to the drive channel 206) the brackets 210 rotate in the backward direction (relative to the path of travel through the warewasher) causing the slide blocks to interact with the channel guides 214 and move the cradle and its dogs (not shown) backward.

Figure 13:
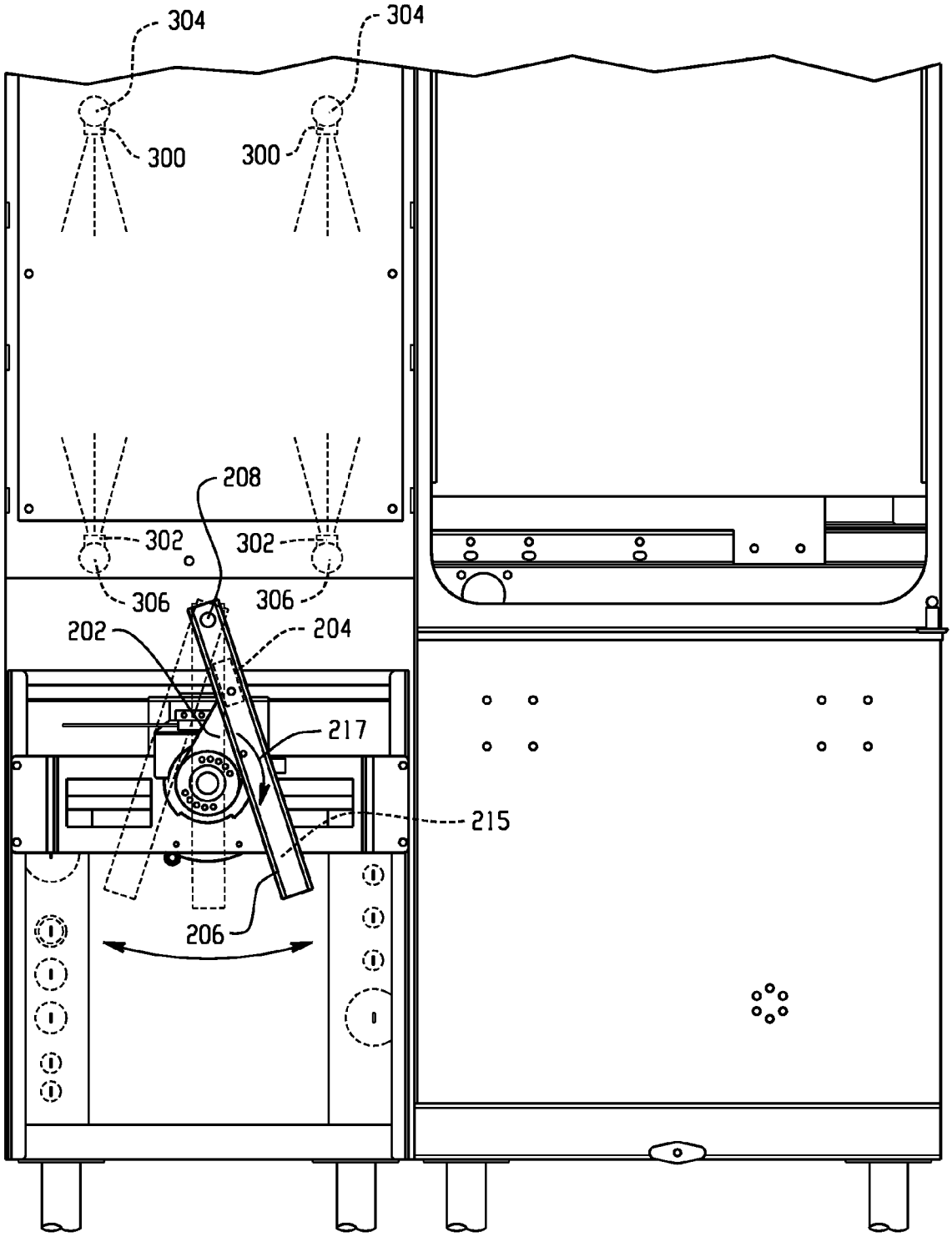

Referring more specifically to the side elevation of FIG. 13, during conveyor driving the crank 202 is rotated continuously in a clockwise manner in the direction of arrow 217 at a generally constant speed. During crank rotation the slide block 204 moves along the length of a drive channel 215 formed by the oscillating member 206. When the slide block 204 is closest to the drive shaft 208, it causes the drive shaft to rotate more rapidly. As the slide block moves further from the drive shaft 208, the speed of rotation of the drive shaft slows. The assembly is arranged so that the drive shaft moves counterclockwise when the slide block is closest to the drive shaft, and clockwise when the slide block is furthest from the drive shaft. Thus, the cradle moves forward at an average velocity that is less than the average velocity when the cradle moves backward, resulting in a rack movement curve approximated by curve 104 in FIG. 7. The drive setup is such that when the crank 202 is rotated, about 240 degrees (or between about 210-270 degrees) of the rotation is driving and about 120 degrees (or between about 90-150 degrees) is retracting. Variations on this are, of course, possible.

Figure 14:
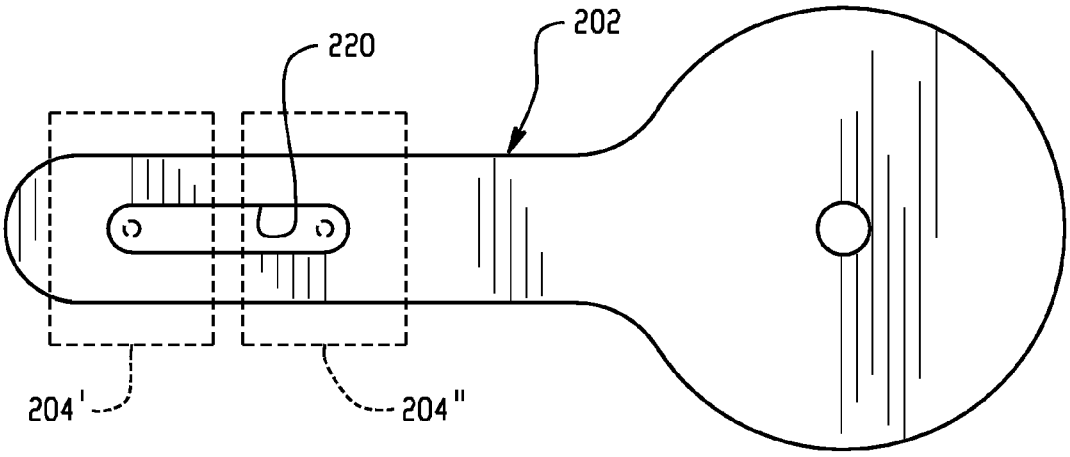
FIG. 14 is a front view of an embodiment of a drive crank for use in the rapid return conveyor system of FIGS. 8-13 including a slot to provide adjustability of stroke length.

Referring to FIG. 14, in order to provide for adjustability of the stroke length of cradle, the crank 202 may include an elongated slot 220 so that the slide block can be pivotally mounted to the crank at multiple locations along the length of the crank. By way of example, if a slide block is mounted with its pivot axis toward the radially outer end of the slot (as per slide block 204'), the stroke length is increased. Conversely, if a slide block is mounted toward the radially inner end of the slot (as per slide block 204"), the stroke length is decreased. This allows the drive system to be adjusted for optimization according to different style racks that have different web spacings (i.e., the stroke length can be adjusted to match the web spacing for each specific rack type).

A typical conveyor-type warewash machine includes one or more spray zones (e.g., typically at least one wash zone and at least one rinse zone) with corresponding spray nozzles located internally of the machine housing within each zone. Exemplary upper 300 and lower 302 spray nozzles are shown schematically in FIG. 13 in association with corresponding upper 304 and lower 306 nozzle arms. However, the position, type and orientation of the spray nozzles can vary widely. The above-described rapid return conveyor can improve the rinse achieved during the rinsing operation.

Figure 15:
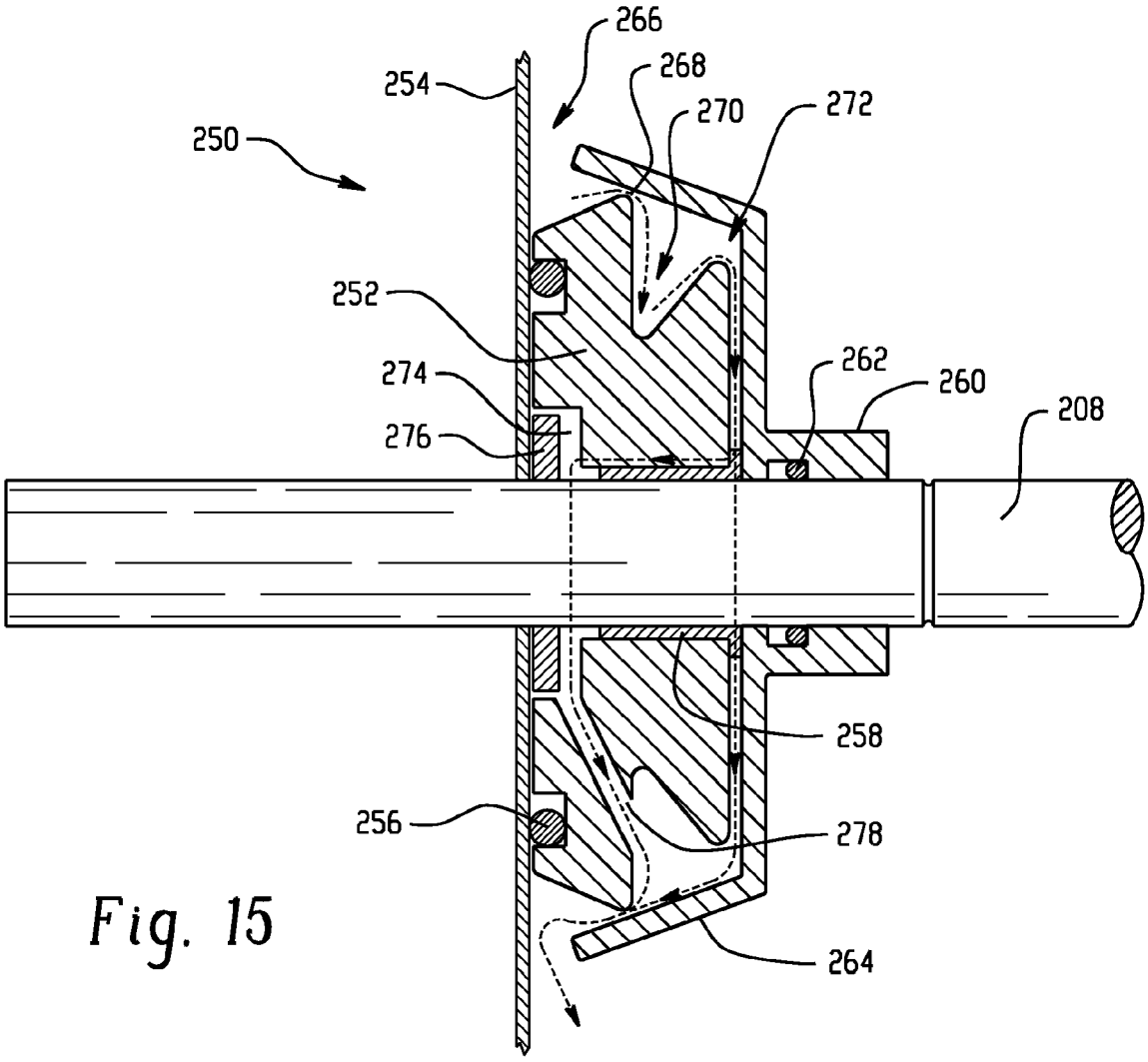
FIG. 15 is a section view of an embodiment of a drive shaft seal assembly for use with the rapid return conveyor system of FIGS. 8-13.

FIGS. 8, 9, 11 and 12 also show a drive shaft seal assembly 250 used to eliminate water from exiting the warewasher housing along the drive shaft 208. The configuration of the shaft seal assembly is best seen in the cross-sectional view of FIG. 15. The assembly includes a bearing housing 252 having a face adjacent the inner side 254 of the tank wall. An o-ring seal 256, which is seated in an annular recess of the bearing housing, prevents water from traveling down the inner wall surface 254, to the shaft and out the housing. The bearing housing includes a central through opening that holds a drive shaft bearing 258. The bearing housing remains stationary as the drive shaft rotates. A water deflector 200 is connected for rotation with the drive shaft 208 (e.g., by a set screw) and an o-ring seal 262 prevents water from migrating along the drive shaft surface through the water deflector 260. The water deflector extends about the bearing housing 252 in a shroud-like manner as shown by deflector wall 264.

Internally of the warewasher the seal assembly 250 is not submerged. Rather, the seal assembly is subjected to impinging water as the result of nozzle overspray and/or water deflection off of wares within the machine. Water entering the bearing area via the upper portion of a space 266 between the deflector and the tank wall cannot move past the o-ring 256 and therefore will most likely travel downward around the outer surface of the bearing housing and back into the tank. If any water travels along an upper portion of a gap 268 between the deflector wall 264 and the bearing housing 252, the bearing housing is constructed with a peripherally extending recessed channel or trough 270 located internally just beyond the gap 268 such that water entering through the gap tends to flow downward along the trough 270 and back into the tank through the lower portion of the gap 268. If any water makes it past the trough 270 into the space 272 between the space between the face of the bearing housing and the face of the deflector, the water will tend to follow one of two paths. Specifically, the water fill flow downward along the space 272 and back through the lower portion of gap 268 into the tank or the water will flow outward along the shaft and bearing into a space 274 that holds a sealing washer 276. When the water traveling along the shaft hits the sealing washer it will fall into the lower end of the space 274 which includes a downward extending weep hole 278 that allows the water to escape from the space 274 and exit the seal assembly along the lower portion of the gap 268 back into the wash tank. The shaft seal assembly may be used in non-warewash devices and/or various shafts that may or may not rotate. The shaft seal assembly is connected to a shaft and inhibits passage of liquid thereby to, for example, escape through an opening in the housing.

Figure 17:
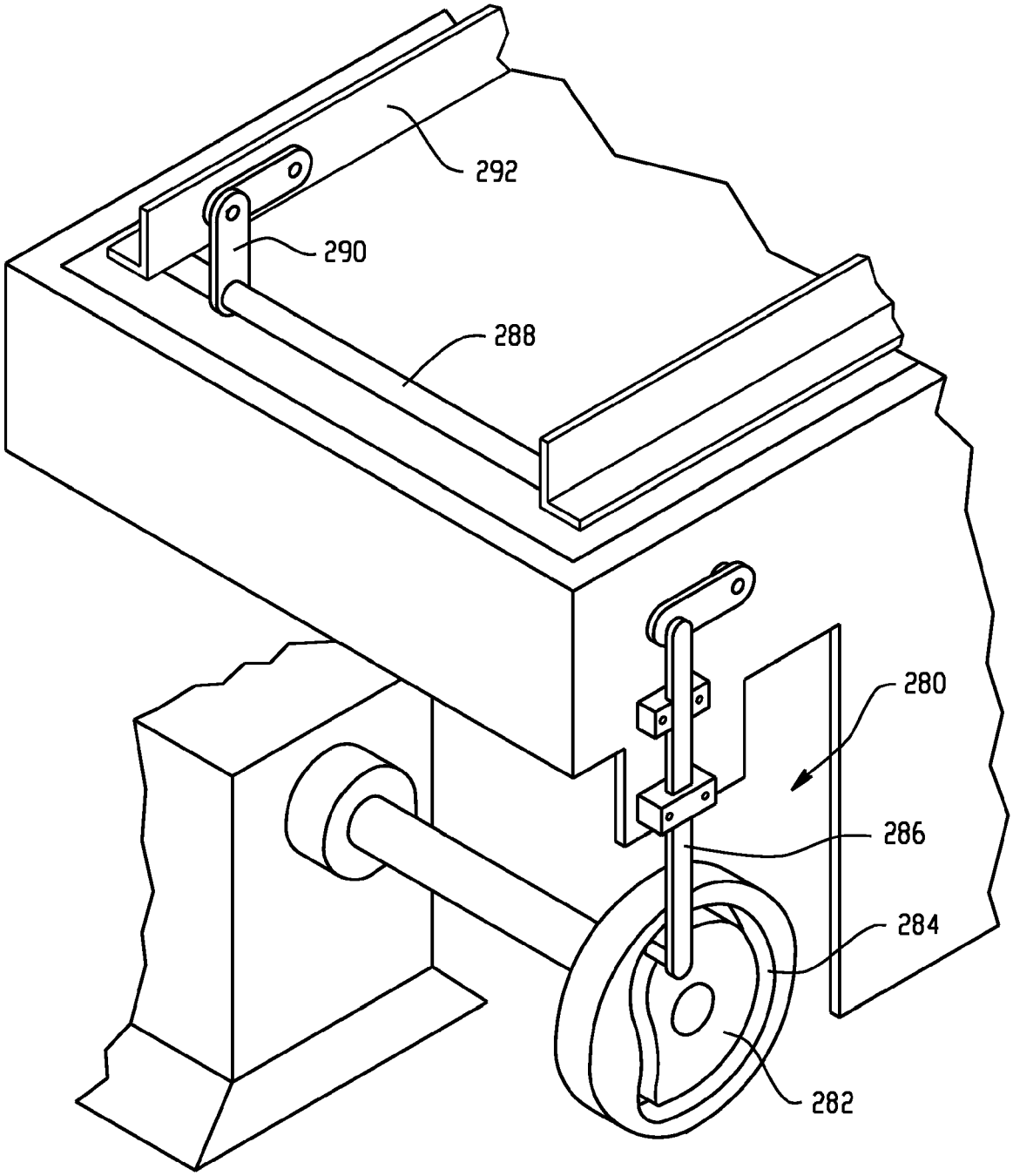
FIG. 17 illustrates another drive embodiment for a rapid return conveyor system.

It is to be clearly understood that the above description is intended by way of illustration and example only and is not intended to be taken by way of limitation, and that changes and modifications are possible. For example, while the oscillating member and 206 and slide block 204 arrangement are described above, other drive systems can be used to accomplish the above described forward and backward drive motions where the return motion is faster than the forward motion. FIG. 17 illustrates a drive cam arrangement 280 including a drive cam 282 including a track 284 within which a follower 286 travels as the cam rotates. The track 284 is shaped to cause the follower 286 to move up-and-down at different rates, which causes the drive shaft 288 to rotate forward and reverse at different rates of speed. The drive shaft 288 is connected to linkage 290, which causes the cradle 292 to move in the forward and reverse directions. Other embodiments are contemplated, such as a four-bar linkage, ball bearing follower, etc. Accordingly, other embodiments are within the scope of the following claims.

What is claimed is:

1. A conveyor-type warewash machine, comprising:

a housing through which wares are passed along a conveyance path for cleaning;

a plurality of spray nozzles within the housing;

a ware conveying system including a drive shaft that extends through a wall of the housing;

a drive shaft seal assembly comprising a substantially stationary bearing housing having a face adjacent the inner surface of the wall and an opening through which the drive shaft passes, and a water deflector coupled for movement with the drive shaft and disposed about the bearing housing with a gap between the water deflector and the bearing housing such that the water deflector is movable relative to the bearing housing upon movement of the drive shaft.

2. The conveyor-type warewash machine of claim 1, wherein the face of the bearing housing includes an associated sealing member that contacts the inner surface of the wall to inhibit liquid from traveling along the inner surface of the wall to the drive shaft.

3. The conveyor-type warewash machine of claim 2, wherein the sealing member is located in an annular recesses formed in the bearing housing.

4. The conveyor-type warewash machine of claim 3 further comprising a drive shaft bearing located in the opening of the bearing housing, the drive shaft extending through the bearing.

5. The conveyor-type warewash machine of claim 4, wherein the face of the bearing housing further includes a central recess radially inward of the sealing member, the central recess including at least one drain hole extending downward through the bearing housing.

6. The conveyor-type warewash machine of claim 5, wherein a sealing washer is disposed about the drive shaft and within the central recess.

7. The conveyor-type warewash machine of claim 1, wherein a water flow path is defined by a space between the interior of the water deflector and the exterior of the bearing housing, the bearing housing including a peripherally extending trough arranged and configured such that water flowing along an upper portion of the flow path tends to enter the trough and travel downward along the trough before flowing back through a lower portion of the flow path.

8. The conveyor-type warewash machine of claim 1, wherein a liquid tank is disposed below the drive shaft assembly.

9. The conveyor-type warewash machine of claim 1 further comprising a drive shaft bearing located in the opening of the bearing housing, the drive shaft extending through the bearing, the gap provides a water flow path by which water can reach the bearing.

10. A conveyor-type warewash machine according to claim 1, wherein the ware conveying system includes a rack drive system including a rack engaging structure that moves back and forth in first and second directions, when moving in the first direction the rack engaging structure moves an adjacent rack forward along the conveyance path, when moving in the second direction the rack engaging structure leaves the adjacent rack substantially stationary, the drive system configured to move the rack engaging structure in the first direction at a first average speed and to move the rack engaging structure in the second direction at a second average speed, where the second average speed is faster than the first average speed so that the adjacent rack spends more time moving forward than being stationary;

wherein the drive system includes a cradle having spaced apart side rails, each side rail having corresponding rack engaging structure thereon, the cradle driven linearly forward in the conveyance direction at the first average speed and linearly backward in a reverse direction at the second average speed, the drive shaft operatively connected to move the cradle back and forth.

11. The conveyor-type warewash machine of claim 10, wherein the drive system comprises:

a drive motor assembly with a drive motor and a motor output shaft;

a drive crank operatively connected to the motor output shaft to effect rotation of the drive crank about a first axis, the drive crank including a linking member that orbits about the first axis;

an oscillating member linked to the drive crank via the linking member to effect oscillating movement of the oscillating member about a second axis as the drive crank is rotated; and the drive shaft defining the second axis and being connected to the oscillating member at an end of the oscillating member to effect bi-directional rotation of the drive shaft as the oscillating member oscillates.

12. A conveyor-type warewash machine, comprising:

a housing through which wares are passed along a conveyance path for cleaning;

a plurality of spray nozzles within the housing;

a ware conveying system including a drive shaft that extends through a wall of the housing;

a drive shaft seal assembly comprising a substantially stationary bearing housing having a face adjacent the inner surface of the wall and an opening through which the drive shaft passes, and a water deflector disposed about the bearing housing and coupled for movement with the drive shaft such that the water deflector rotates with the drive shaft and relative to the stationary bearing housing;

wherein the face of the bearing housing includes an associated sealing member that contacts the inner surface of the wall to inhibit liquid from traveling along the inner surface of the wall to the drive shaft;

wherein the sealing member is located in an annular recesses formed in the bearing housing;

a drive shaft bearing located in the opening of the bearing housing, the drive shaft extending through the bearing;

wherein a water flow path is defined by a space between the interior of the water deflector and the exterior of the bearing housing, the bearing housing including a peripherally extending trough arranged and configured such that water flowing along an upper portion of the flow path tends to enter the trough and travel downward along the trough before flowing back through a lower portion of the flow path;

wherein the face of the bearing housing further includes a central recess radially inward of the sealing member, the central recess including at least one drain hole extending downward through the bearing housing;

wherein a sealing washer is disposed about the drive shaft and within the central recess.

* * * * *